US010791795B2

(12) United States Patent
Campos, II et al.

(10) Patent No.: US 10,791,795 B2
(45) Date of Patent: Oct. 6, 2020

(54) ARTICLE WITH A CUSHIONING ASSEMBLY HAVING INNER AND OUTER BLADDER ELEMENTS AND A REINFORCEMENT ELEMENT AND METHOD OF MANUFACTURING AN ARTICLE

(71) Applicant: NIKE, Inc., Beaverton, OR (US)

(72) Inventors: Fidencio Campos, II, Dallas, OR (US); Zachary M. Elder, Portland, OR (US); Benjamin J. Monfils, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 452 days.

(21) Appl. No.: 15/093,116

(22) Filed: Apr. 7, 2016

(65) Prior Publication Data

US 2016/0295968 A1 Oct. 13, 2016

Related U.S. Application Data

(60) Provisional application No. 62/144,589, filed on Apr. 8, 2015.

(51) Int. Cl.

| | |
|---|---|
| ***A43B 13/20*** | (2006.01) |
| ***A43B 13/22*** | (2006.01) |
| ***A43B 13/18*** | (2006.01) |

(52) U.S. Cl.

CPC ..... *A43B 13/20* (2013.01); *A43B 13/184* (2013.01); *A43B 13/223* (2013.01)

(58) Field of Classification Search

CPC ..... A43B 13/20; A43B 13/206; A43B 13/189; A43B 13/187; A43B 13/203;

(Continued)

(56) References Cited

U.S. PATENT DOCUMENTS

| | | | |
|---|---|---|---|
| 2,269,342 | A | 1/1942 | Johnson |
| 2,677,906 | A | 5/1954 | Reed |

(Continued)

FOREIGN PATENT DOCUMENTS

| | | | |
|---|---|---|---|
| CN | 1206571 | A | 2/1999 |
| CN | 101242941 | A | 8/2008 |

(Continued)

OTHER PUBLICATIONS

American Society for Testing and Materials (ASTM) Standard D1003-00, Standard Test Method for Haze and Luminous Transmittance of Transparent Plastics, Jul. 2000, Book of Standards vol. 08.01, ASTM International, Pennsylvania, USA.

*Primary Examiner* — Nathan E Durham
*Assistant Examiner* — Abby M Spatz
(74) *Attorney, Agent, or Firm* — Quinn IP Law

(57) ABSTRACT

An article comprises a cushioning assembly that comprises a first bladder element forming a first fluid chamber. The cushioning assembly further comprises a second bladder element within the first bladder element. The second bladder element forms a second fluid chamber sealed from and within the first fluid chamber. At least one reinforcement element is operatively connected to and in contact with at least one of the first bladder element and the second bladder element. The at least one reinforcement element is configured to reinforce the cushioning assembly under a load applied to the first bladder element. A method of manufacturing an article with the cushioning assembly is provided.

13 Claims, 10 Drawing Sheets

(58) Field of Classification Search
CPC ... A43B 23/029; A43B 13/184; A43B 13/223; A43B 13/181; A43B 17/03; A42B 3/122
USPC ..... 36/29, 35 B, 28, 35 R, 43
See application file for complete search history.

(56) References Cited

U.S. PATENT DOCUMENTS 3,469,576 A 9/1969 Smith et al.
3,568,227 A 3/1971 Dunham
4,183,156 A 1/1980 Rudy
4,219,945 A 9/1980 Rudy
4,271,606 A 6/1981 Rudy
4,547,919 A 10/1985 Wang
4,779,359 A 10/1988 Famolare, Jr.
4,936,029 A 6/1990 Rudy
4,999,931 A 3/1991 Vermeulen
5,042,176 A 8/1991 Rudy
5,220,737 A 6/1993 Edington
5,493,791 A * 2/1996 Kramer ..... A43B 7/081 36/28
5,564,202 A 10/1996 Hoppenstein
5,575,088 A 11/1996 Allen et al.
5,595,004 A 1/1997 Lyden et al.
5,713,141 A 2/1998 Mitchell et al.
5,952,065 A 9/1999 Mitchell et al.
5,979,078 A * 11/1999 McLaughlin ..... A43B 13/203 36/29
5,985,383 A 11/1999 Allen et al.
5,987,781 A * 11/1999 Pavesi ..... A43B 13/20 36/29
6,009,637 A 1/2000 Pavone
6,013,340 A 1/2000 Bonk et al.
6,041,519 A 3/2000 Cheng
6,082,025 A 7/2000 Bonk et al.
6,127,026 A 10/2000 Bonk et al.
6,203,868 B1 3/2001 Bonk et al.
6,321,465 B1 11/2001 Bonk et al.
6,503,355 B1 1/2003 Anzani et al.
6,516,540 B2 2/2003 Seydel et al.
6,537,639 B1 3/2003 Huang
6,751,892 B2 6/2004 Chavet et al.
6,971,193 B1 12/2005 Potter et al.
6,976,321 B1 12/2005 Lakic
7,204,041 B1 4/2007 Bailey, Sr. et al.
7,244,483 B2 7/2007 Tawney et al.
7,437,835 B2 10/2008 Marvin et al.
7,451,555 B1 11/2008 Lakic
7,694,438 B1 4/2010 Christensen et al.
7,779,558 B2 8/2010 Nishiwaki et al.
7,788,824 B2 9/2010 Hann
7,802,378 B2 9/2010 Harmon Weiss et al.
8,122,615 B2 2/2012 Lucas et al.
8,125,796 B2 2/2012 Ellis
8,256,147 B2 9/2012 Ellis
8,635,786 B2 1/2014 Aveni et al.
8,656,608 B2 2/2014 Goodwin et al.
8,848,368 B2 9/2014 Eilis
2002/0121031 A1 9/2002 Smith et al.
2003/0097767 A1 5/2003 Perkinson
2003/0183324 A1 10/2003 Tawney et al.
2004/0148809 A1 8/2004 Kikuta et al.
2004/0194343 A1 10/2004 Kim
2006/0137221 A1 6/2006 Dojan et al.
2007/0113426 A1 5/2007 Abadjian et al.
2007/0256326 A1* 11/2007 Jarvis ..... A43B 13/12 36/28
2007/0294832 A1 12/2007 Shiao
2009/0151196 A1 6/2009 Schindler et al.
2009/0178302 A1 7/2009 Kim
2009/0183387 A1 7/2009 Ellis
2009/0293305 A1 12/2009 Pelsue et al.
2010/0094184 A1 4/2010 Wong et al.
2010/0129573 A1* 5/2010 Kim ..... B32B 3/10 428/34.1
2010/0319214 A1 12/2010 Issler
2011/0162232 A1 7/2011 Gazzara et al.
2011/0162233 A1 7/2011 Shiao
2011/0277346 A1* 11/2011 Peyton ..... A43B 13/20 36/29
2012/0260524 A1 10/2012 Izquieta Anaut
2012/0260526 A1* 10/2012 Smith ..... A43B 13/20 36/83
2013/0167402 A1* 7/2013 Christensen ..... A43B 13/184 36/29
2013/0174447 A1 7/2013 Sills
2013/0227858 A1 9/2013 James
2014/0090189 A1 4/2014 Parker
2014/0109440 A1* 4/2014 McDowell ..... A43B 3/246 36/103
2014/0230272 A1 8/2014 Feshbach et al.
2014/0230276 A1 8/2014 Campos, II et al.
2014/0250728 A1 9/2014 Devoe et al.
2014/0283413 A1 9/2014 Christensen et al.
2015/0033577 A1 2/2015 Dahl et al.
2015/0272271 A1 10/2015 Campos, II et al.
2015/0272272 A1 10/2015 Scofield
2015/0273778 A1 10/2015 Campos, II et al.
2016/0295967 A1 10/2016 Campos, II et al.
2018/0070675 A1 3/2018 Campos, II et al.

FOREIGN PATENT DOCUMENTS

EA 0170060 A2 9/2001
EP 0771694 A2 5/1997
EP 0780064 A2 6/1997
JP 2002238613 A 8/2002
WO 9111931 A1 8/1991
WO 2017079255 A1 5/2017

* cited by examiner

ARTICLE WITH A CUSHIONING ASSEMBLY HAVING INNER AND OUTER BLADDER ELEMENTS AND A REINFORCEMENT ELEMENT AND METHOD OF MANUFACTURING AN ARTICLE

CROSS-REFERENCE TO RELATED APPLICATION

This application claims the benefit of U.S. Provisional Application No. 62/144,589 filed Apr. 8, 2015, which is hereby incorporated by reference in its entirety.

TECHNICAL FIELD

The present teachings generally include an article with a cushioning assembly, and a method of manufacturing an article.

BACKGROUND

Footwear typically includes a sole configured to be located under a wearer's foot to space the foot away from the ground or floor surface. Footwear sometimes utilizes polyurethane foam or other resilient materials in the sole to provide cushioning. A fluid-filled bladder element is sometimes included in the sole to provide desired cushioning.

DESCRIPTION

Figure 1:
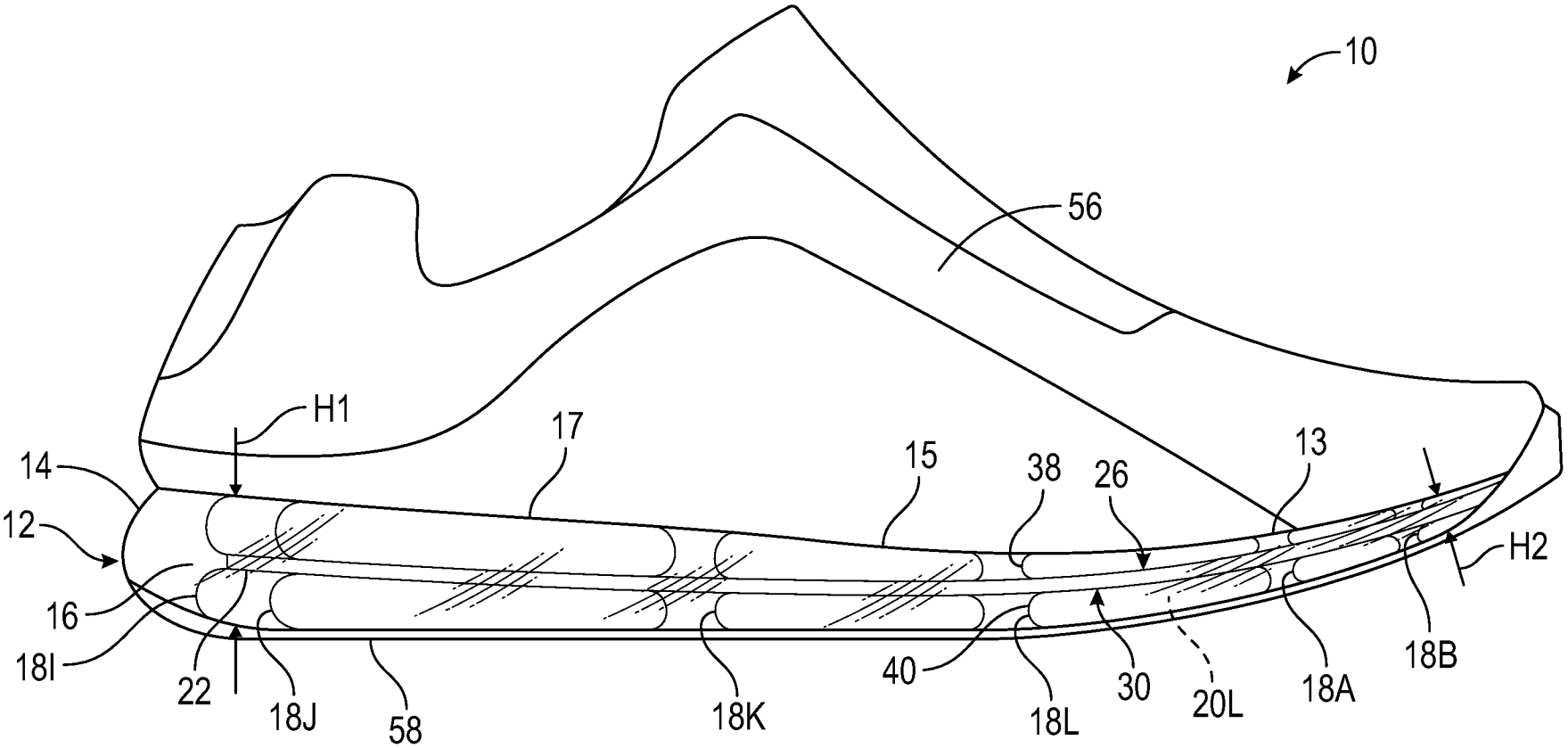
FIG. 1 is a schematic illustration in side view of a medial side of an article of footwear including a cushioning assembly.

An article comprises a cushioning assembly that comprises a first bladder element forming a first fluid chamber. The cushioning assembly further comprises a second bladder element within the first bladder element. The second bladder element forms a second fluid chamber sealed from and within the first fluid chamber. At least one reinforcement element is operatively connected to and in contact with at least one of the first bladder element and the second bladder element. The at least one reinforcement element is configured to reinforce the cushioning assembly under a load applied to the first bladder element.

The article may further comprise a sole layer. The first bladder element may be secured to the sole layer, and the at least one reinforcement element may be secured to the sole layer and pivotable about a first pivot axis as a fulcrum. The at least one reinforcement element may comprise a first reaction surface that contacts a first portion of an outer surface of the first bladder element when the at least one reinforcement element is pivoted about the first pivot axis. In an embodiment in which the article is an article of footwear, the pivot axis may extend generally from a lateral side of the article of footwear to a medial side of the article of footwear and the first reaction surface may be forward of the second bladder element.

In an embodiment, the at least one reinforcement element may comprise a first reinforcement element forward of the second bladder element and a second reinforcement element rearward of the second bladder element. The second reinforcement element may be pivotable about a second pivot axis, and may comprise an additional first reaction surface that contacts a second portion of the outer surface of the first bladder element when the second reinforcement element is pivoted about the second pivot axis.

In an embodiment, the cushioning assembly may further comprise a third bladder element forming a third fluid chamber, and a fourth bladder element within the third bladder element and forming a fourth fluid chamber sealed from and within the third fluid chamber. The third bladder element may be rearward of the second reinforcement element. The second reinforcement element may comprise a second reaction surface that contacts a portion of the outer surface of the third bladder element when the second reinforcement element is pivoted about the second axis. The portion of the outer surface of the third bladder element is rearward of the second reaction surface and adjacent the fourth bladder element.

In an embodiment, the second bladder element comprises a flange forming a peripheral seam that surrounds the second bladder element and seals the second fluid chamber. The at least one reinforcement element may comprise a first collar that is secured to the flange and at least partially surrounds the second bladder element at the flange to reinforce the peripheral seam and limit deformation of the second bladder element at the peripheral seam. In an embodiment in which the article is an article of footwear, the peripheral seam and the first reinforcement element may incline within the first bladder element in a laterally outward direction of the article of footwear.

In an embodiment, the at least one reinforcement element may comprise a second reinforcement element, and the cushioning assembly further comprises a third bladder element forming a third fluid chamber within the first fluid chamber. The third bladder element may comprise a flange forming a peripheral seam that surrounds the third bladder element and seals the third fluid chamber. The at least one reinforcement element may comprise a second collar that is secured to the flange of the third bladder element and at least partially surrounds the third bladder element at the flange of the third bladder element to reinforce the peripheral seam of the third bladder element and limit deformation of the third bladder element at the peripheral seam of the third bladder element. In an embodiment in which the article is an article of footwear, the peripheral seam of the third bladder element and the second reinforcement element may incline within the first bladder element in a laterally outward direction of the article of footwear.

In an embodiment, the at least one reinforcement element comprises a frame disposed within the first bladder element and forming a first opening. The second bladder element may extend through the first opening and may be narrowed at and retained by the frame at the first opening.

In an embodiment, the frame may comprise a first side with a first surface and a second side with a second surface. The second bladder element may comprise a first portion that rests against the first surface, a second portion that rests against the second surface, and a necked portion that extends through the opening in the frame and connects the first portion to the second portion. The first portion may be in fluid communication with the second portion through the necked portion so that a load applied to the second bladder element is reacted by both the first surface and the second surface of the frame.

In an embodiment in which the article is an article of footwear, the first side of the frame is disposed generally upward and the second side of the frame is disposed generally downward when the article of footwear is in an upright position and the cushioning assembly is secured in the article of footwear so that the first portion is generally above the second portion. The article of footwear may comprise a forefoot portion, a midfoot portion, and a heel portion, and the frame may extend lengthwise in the article of footwear from the forefoot portion to the heel portion.

In an embodiment, the frame may form an additional opening, and the cushioning assembly may further comprise a third bladder element forming a third fluid chamber within the first fluid chamber and extending through the additional opening. The third bladder element may comprise a first portion that rests against the first surface, a second portion that rests against the second surface, and a necked portion that extends through the additional opening in the frame and connects the first portion of the third bladder element to the second portion of the third bladder element; and wherein the first portion of the third bladder element is in fluid communication with the second portion of the third bladder element through the necked portion.

In an embodiment, at least one of the first fluid chamber and the second fluid chamber is pressurized above an ambient pressure surrounding the first fluid chamber when said at least one of the first fluid chamber and the second fluid chamber is in an unloaded state. In an embodiment, the article may be an article of footwear that comprises a forefoot portion, a midfoot portion, and a heel portion, and the first bladder element may extend from the forefoot portion to the heel portion.

A method of manufacturing an article may comprise operatively connecting at least one reinforcing element to at least one of a first bladder element or a second bladder element of a cushioning assembly. The first bladder element may form a first fluid chamber and the second bladder element may be within the first bladder element and form a second fluid chamber sealed from and within the first fluid chamber. The at least one reinforcement element may comprise a reaction surface and may be configured to reinforce the cushioning assembly when at least one of the first bladder element and the second bladder element is in contact with the reaction surface under a load applied to the first bladder element.

The method may further comprise inserting the second bladder element through an opening in the at least one reinforcement element so that the second bladder element extends through the opening and is retained by the at least one reinforcement element at the opening.

In an embodiment, the method may further comprise securing the reinforcement element to a flange forming a peripheral seam of the second bladder element so that the reinforcement element at least partially surrounds the second bladder element at the flange to reinforce the peripheral seam.

In an embodiment, the method may further comprise pressurizing at least one of the first fluid chamber and the second fluid chamber above an ambient pressure surrounding the first fluid chamber when the at least one of the first fluid chamber and the second fluid chamber is in an unloaded state. In an embodiment in which the article is an article of footwear, a map of magnitudes of pressures applied during wear testing of an article of footwear can be determined. The first fluid chamber and the second fluid chamber can then be inflated to pressurize the first fluid chamber and the second fluid chamber to respective pressures that correlate with the map.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Referring to the drawings, wherein like reference numbers refer to like features throughout the views, FIG. 1 shows an article 10 that includes a cushioning assembly 12 having features that provide cushioning, stability, and responsiveness. As shown in FIG. 1, the article 10 may be an article of footwear 10 that is an athletic shoe. In other embodiments, the cushioning assembly 12 could be for an article of footwear that is a dress shoe, a work shoe, a sandal, a slipper, a boot, or any other category of footwear. Alternatively, the cushioning assembly 12 could be used as a cushioning element in another article, such as but not limited to a shoulder strap, a backpack, a shoulder pad, a glove, an elbow pad, a knee pad, a shin guard, or other apparel, or a sports ball.

Figure 2:
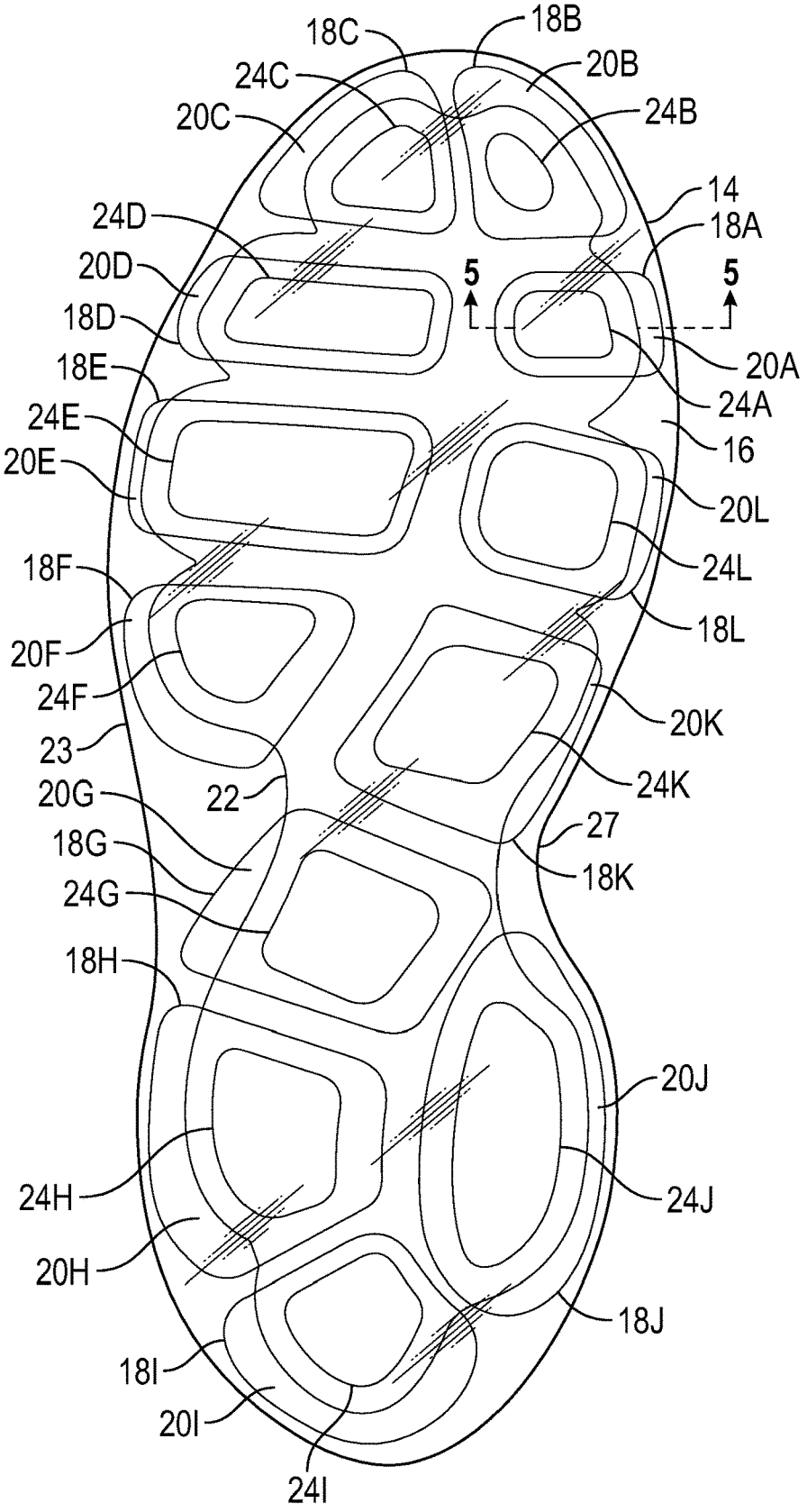
FIG. 2 is a schematic illustration in top view of a portion of the cushioning assembly of FIG. 1.
Figure 3:
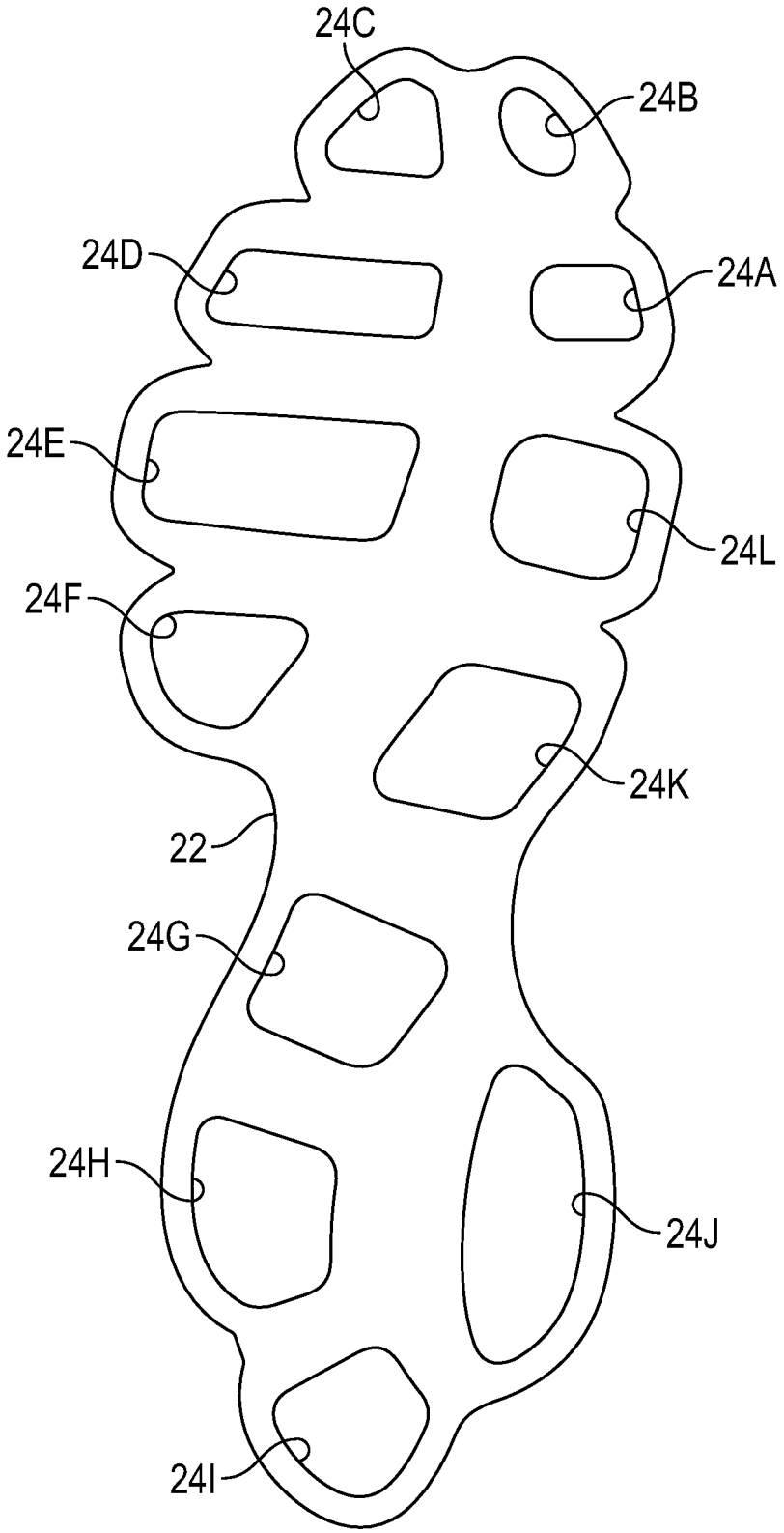
FIG. 3 is a schematic illustration in top view of a reinforcement element that is a frame of the cushioning assembly of FIG. 1.

More specifically, the cushioning assembly 12 has multiple bladder elements, including a first bladder element 14 forming a first fluid chamber 16, and a second bladder element 18A within the first bladder element 14. The second bladder element 18A forms a second fluid chamber 20A that is sealed from and within the first fluid chamber 16. Due to this arrangement, the first bladder element 14 is also referred to as an outer bladder element, and the second bladder element 18A is also referred to as an inner bladder element. The article of footwear 10 comprises a forefoot portion 13, a midfoot portion 15, and a heel portion 17. The forefoot portion 13 is generally the forward-most third of the article of footwear 10 when worn on a foot, the midfoot portion 15 is generally the middle third, and the heel portion 17 is generally the rearmost third. The first bladder element 14 of the cushioning assembly 12 is referred to as a full length bladder element 14 as it extends from the forefoot portion 13, over the midfoot portion 15 to the heel portion 17. Heel portion 17 generally includes portions of the article of footwear 10 and cushioning assembly 12 corresponding with rear portions of a human foot of a size corresponding with the article of footwear 10, including the calcaneus bone. Forefoot portion 13 generally includes portions of the article of footwear 10 and cushioning assembly 12 corresponding with the toes and the joints connecting the metatarsals with the phalanges of the human foot of the size corresponding with the article of footwear 10. Midfoot portion 15 generally includes portions of the article of footwear 10 and cushioning assembly 12 corresponding with an arch area of the human foot of the size corresponding with the article of footwear 10. As used herein, a lateral side of a component for an article of footwear 10, such as a lateral side 23 of the cushioning assembly 12 indicated in FIG. 2, is a side that corresponds with the side of the foot of the wearer of the article of footwear 10 that is generally further from the other foot of the wearer (i.e., the side closer to the fifth toe of the wearer). The fifth toe is commonly referred to as the little toe. A medial side of a component for an article of footwear 10, such as a medial side 27 of the cushioning assembly 12 indicated in FIG. 2, is the side that corresponds with an inside area of the foot of the wearer and is generally closer to the other foot of the wearer (i.e., the side closer to the hallux of the foot of the wearer). The hallux is commonly referred to as the big toe.

As further discussed herein, the cushioning assembly 12 also includes multiple additional inner bladder elements 18B, 18C, 18D, 18E, 18F, 18G, 18H, 18I, 18J, 18K, 18L, each of which is also within the first bladder element 14. Each additional inner bladder element 18B, 18C, 18D, 18E, 18F, 18G, 18H, 18I, 18J, 18K, 18L forms a separate fluid chamber 20B, 20C, 20D, 20E, 20F, 20G, 20H, 20I, 20J, 20K, 20L that is sealed from and within the first fluid filled chamber 16. For purposes of discussion, the bladder element 18L is referred to as the third bladder element, and the fluid chamber 20L is referred to as the third fluid chamber. As is apparent from FIGS. 1 and 2, the inner bladder elements 18A, 18B, 18C, 18D, 18E, 18F, 18E, 18G, 18H, 18I, 18J, 18K, 18L decrease in height from the heel portion 17 to the forefoot portion 13. Bladder element 18I is of the largest height H1, and bladder element 18B is of the smallest height H2.

As used herein, a "fluid" includes a gas, including air, an inert gas such as nitrogen, or another gas. Accordingly, "fluid-filled" includes "gas-filled". The various materials used for the bladder elements 14, 18A, 18B, 18C, 18D, 18E, 18F, 18E, 18G, 18H, 18I, 18J, 18K, 18L, and other embodiments of bladder elements discussed herein, may be substantially transparent. The various materials used for the bladder element 14, and other embodiments of bladder elements discussed herein, may be substantially transparent. Additionally, in some embodiments, the bladder element 14 may have a tinted color.

The fluid-filled bladder elements 14, 18A, 18B, 18C, 18D, 18E, 18F, 18E, 18G, 18H, 18I, 18J, 18K, 18L and other embodiments of bladder elements described herein can be formed from a variety of polymeric materials. For example, the bladder elements 14, 18A, 18B, 18C, 18D, 18E, 18F, 18E, 18G, 18H, 18I, 18J, 18K, 18L can be formed from any of various polymeric materials that can retain a fluid at a predetermined pressure, including a fluid that is a gas, such as air, nitrogen, or another gas. For example, the bladder elements 14, 18A, 18B, 18C, 18D, 18E, 18F, 18E, 18G, 18H, 18I, 18J, 18K, 18L can be a thermoplastic polymeric material. The bladder elements 14, 18A, 18B, 18C, 18D, 18E, 18F, 18E, 18G, 18H, 18I, 18J, 18K, 18L can be a urethane, polyurethane, polyester, polyester polyurethane, and/or polyether polyurethane.

Figure 5:
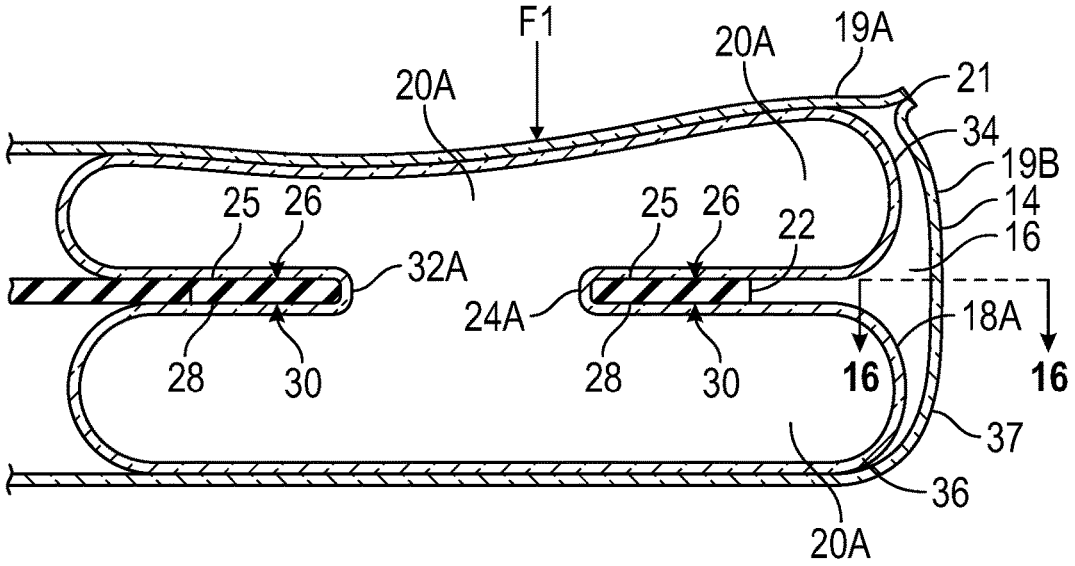
FIG. 5 is a schematic cross-sectional illustration of a portion of the cushioning assembly taken at lines 5-5 in FIG. 2.
Figure 16:
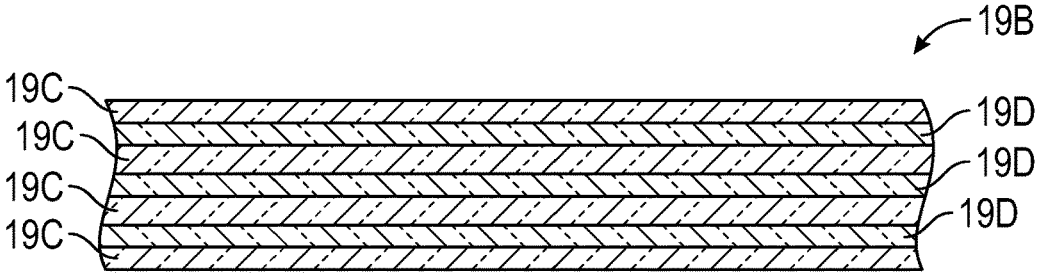
FIG. 16 is a schematic illustration in fragmentary cross-sectional view of the inner bladder element of FIG. 5 taken at lines 16-16 in FIG. 5.

Moreover, the bladder elements 14, 18A, 18B, 18C, 18D, 18E, 18F, 18E, 18G, 18H, 18I, 18J, 18K, 18L can be formed of one or more sheets having layers of different materials. In FIG. 5, the first bladder element 14 is formed from a first polymeric sheet 19A secured to a second polymeric sheet 19B at a flange forming a peripheral seam 21. FIG. 16, which is a close-up fragmentary cross-sectional portion of the first fluid-filled bladder element 14 in an article of footwear 10 taken at lines 13-13 in FIG. 5, shows that the second polymeric sheet 19B is a laminate membrane formed from thin films having one or more first layers 19C that comprise thermoplastic polyurethane layers and that alternate with one or more second layers 19D, also referred to herein as barrier layers, gas barrier polymers, or gas barrier layers, that comprise a copolymer of ethylene and vinyl alcohol (EVOH) that is impermeable to the pressurized fluid contained therein as disclosed in U.S. Pat. No. 6,082,025 to Bonk et al., which is incorporated by reference in its entirety. The first polymeric sheet 19A may be formed from the same materials shown and described in FIG. 16 with respect to the second polymeric sheet 19B. The first layer 19C may be arranged to form an outer surface of the second polymeric sheet 19B. That is, the outermost first layer 19C shown in FIG. 16 may be the outer surface of the first fluid-filled bladder element 14. The first fluid-filled bladder element 14 may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The bladder element 14 may also be a flexible microlayer membrane that includes alternating layers of a gas barrier polymer material such as second layers 19D and an elastomeric material such as first layers 19C, as disclosed in U.S. Pat. Nos. 6,082,025 and 6,127,026 to Bonk et al. which are incorporated by reference in their entireties. With such alternating layers, for example, the bladder element 14 or any of the additional bladder elements 18A, 18B, 18C, 18D, 18E, 18F, 18E, 18G, 18H, 18I, 18J, 18K, 18L may have a gas transmission rate for nitrogen of less than 10 cubic centimeters per square meter per atmosphere per day, or of less than 1 cubic centimeter per square meter per atmosphere per day. Additional suitable materials for the bladder element 14 are disclosed in U.S. Pat. Nos. 4,183,156 and 4,219,945 to Rudy which are incorporated by reference in their entireties. Further suitable materials for the bladder element 14 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the bladder element 14, engineering properties such as tensile strength, stretch properties, fatigue characteristics, dynamic modulus, and loss tangent can be considered. The thicknesses of the first and second polymeric sheets 19A, 19B of materials used to form the bladder element 14 can be selected to provide these characteristics.

The cushioning assembly 12 also includes at least one reinforcement element 22 operatively connected to and in contact with the first bladder element 14, the second bladder element 18A, and the additional bladder elements 18B, 18C, 18D, 18E, 18F, 18G, 18H, 18I, 18J, 18K, and 18L. In the embodiment of FIG. 1, the reinforcement element 22 is a retainer frame 22, and is also referred to as a frame. The retainer frame 22 extends lengthwise in the article of footwear 10 from the forefoot portion to the heel portion.

The retainer frame 22 is configured to reinforce the cushioning assembly 12 under a load applied to the first bladder element 14 as discussed herein. The retainer frame 22 can be a variety of materials such as but not limited to thermoplastic polyurethane, thermoplastic elastomer, an EVA foam, a carbon fiber, or a composite of foam and carbon fiber, and can have a stiffness and thickness selected to provide a desired amount of stability and flexibility for the cushioning assembly 12.

The retainer frame 22 is disposed within the first bladder element 14 and forms multiple openings 24A, 24B, 24C, 24D, 24E, 24F, 24G, 24H, 24I, 24J, 24K, and 24L. The opening 24A is referred to as a first opening 24A. As best shown in FIGS. 1 and 5, the second bladder element 18A extends through the first opening 24A. The second bladder element 18A is narrowed at the first opening 24A at a narrowed portion 32A that can also be referred to as a necked portion 32A. The retainer frame 22 has a first side 25 with a first surface 26. The retainer frame 22 also has a second side 28 that is opposite the first side 25. The second side 28 has a second surface 30. The first side 25 of the retainer frame 22 is disposed generally upward and the second side 28 of the retainer frame 22 is disposed generally downward when the cushioning assembly 12 is secured in the article of footwear 10 so that a first portion 34 is generally above a second portion 36 when the article of footwear 10 is in an upright position.

The openings 24A, 24B, 24C, 24D, 24E, 24F, 24G, 24H, 24I, 24J, 24K, and 24L extend completely through the retainer frame 22 from the first side 25 to the second side 28. The openings 24A, 24B, 24C, 24D, 24E, 24F, 24G, 24H, 24I, 24J, 24K, and 24L enable the bladder elements 18A, 18B, 18C, 18D, 18E, 18F, 18G, 18H, 18I, 18J, 18K, and 18L to extend through the retainer frame 22. For example, the second bladder element 18A comprises the first portion 34 that rests against the first surface 26, and the second portion 36 that rests against the second surface 30. The necked portion 32A connects the first portion 34 to the second portion 36 so that the first portion 34 is in fluid communication with the second portion 36 through the necked portion 32A. Stated differently, the second fluid chamber 20A extends from the first portion 34 to the second portion 36 through the necked portion 32A. This enables a load F1 on the second bladder element 18A to be reacted by both the first surface 26 and the second surface 30 of the retainer frame 22. The load F1 is applied to the second bladder element 18A indirectly through the first bladder element 14. The retainer frame 22 surrounding the necked portion 32A prevents lateral expansion of the bladder element 14 at the necked portion 32A under loading. This, in turn, limits outward deformation at a side surface 37 of the first fluid-filled bladder element 14.

The cushioning dynamics and energy absorption of the cushioning assembly 12 is at least in part due to the selected steady state fluid pressure in the first fluid chamber 16 and the selected steady state fluid pressure in the second fluid chamber 20A. The steady state fluid pressure is the fluid pressure when the cushioning assembly 12 is unloaded, such as when the article of footwear 10 is not in use. The steady state fluid pressure is the respective inflation pressures of the fluid used to fill the fluid chambers 16, 20A. The relative pressures in the fluid chambers 16 and 20A affect dampening of the load F1 and can be selected (i.e., "tuned") to provide a desired cushioning response. For example, at least one of the first fluid chamber 16 and the second fluid chamber 20A can be pressurized above an ambient pressure when in an unloaded state. The ambient pressure is the pressure surrounding the first fluid chamber 16, external to the article of footwear 10. In one embodiment, the first fluid chamber 16 is at ambient pressure, and the second fluid chamber 20A is pressurized above ambient pressure. When a load is applied to the cushioning assembly 12, the fluid-pressure in the first fluid-filled bladder element 14 may provide an initial, relatively soft cushioning feel, with the higher pressure and therefore stiffer second bladder element 18A then providing an increased rate of dampening as one or more of the inner bladder elements 18A, 18B, 18C, 18D, 18E, 18F, 18G, 18H, 18I, 18J, 18K, and 18L, depending on the location of the load, is compressed. Additionally, the fluid chambers 20A, 20B, 20C, 20D, 20E, 20F, 20G, 20H, 20I, 20J, 20K, and 20L of the various inner bladder elements 18A, 18B, 18C, 18D, 18E, 18F, 18G, 18H, 18I, 18J, 18K, and 18L can be pressurized at different pressures to affect the cushioning profile of the article of footwear 10. For example, fluid chambers 20A, 20B, 20C, and 20D of the bladder elements 18A, 18B, 18C, and 18D in the forefoot portion 13 can be at higher pressures than the fluid chambers 20J, 20I, 20H in the heel portion 17. Additionally, fluid chambers 20A, 20L of bladder elements 18A, 18L on the medial side 27 can be at higher pressures than fluid chambers 20D, 20E of bladder elements 18D, 18E on the lateral side 23. In one embodiment, a pressure map of pressures applied to a forefoot portion, a midfoot portion, and a heel portion during wear of a test article of footwear can be determined. The bladder elements 18A, 18B, 18C, 18D, 18E, 18F, 18G, 18H, 18I, 18J, 18K, and 18L can then be inflated to pressurize the fluid chambers 20A, 20B, 20C, 20D, 20E, 20F, 20G, 20H, 20I, 20J, 20K, and 20L to respective pressures that correlate with the pressure map.

The retainer frame 22 provides reaction surfaces 26, 30 that the bladder elements 18A, 18B, 18C, 18D, 18E, 18F, 18G, 18H, 18I, 18J, 18K, and 18L contact and react against when a load is applied to the cushioning assembly 12. The retainer frame 22 also helps prevent lateral twisting of the cushioning assembly 12. Moreover, when the article of footwear 10 is flexed, such as when the forefoot portion 13 is flexed upward relative to the midfoot portion 15, the retainer frame 22 will be biased back to its unflexed position shown in FIG. 1, providing a snap back energy return.

Figure 4:
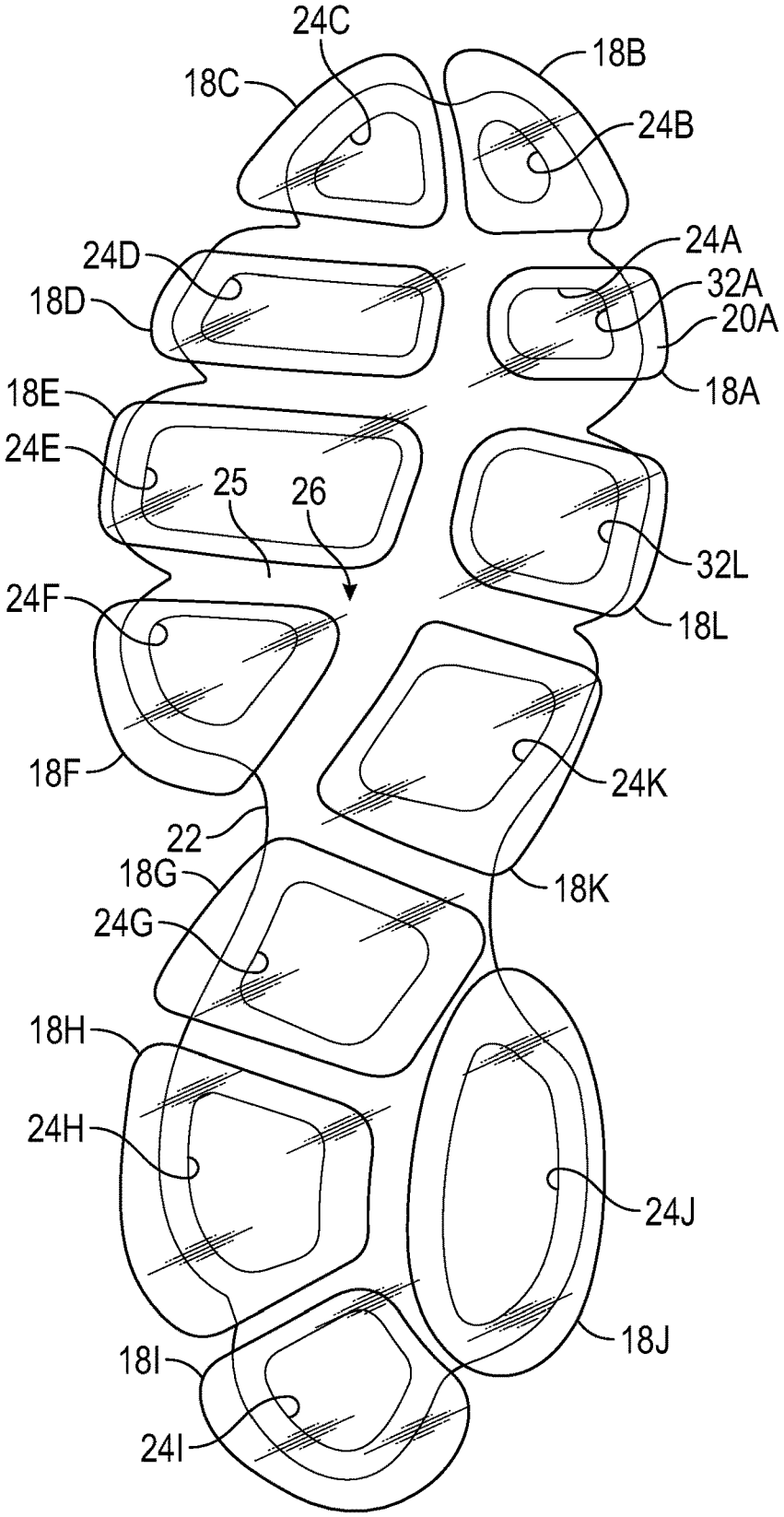
FIG. 4 is a schematic illustration in top view of the frame of FIG. 3 with inner bladder elements of the cushioning assembly extending through the frame and with an outer bladder element removed.

The bladder element 18L may be referred to as the third bladder element, and forms a third fluid chamber 20L within the first fluid chamber 16 as best indicated in FIG. 2. The bladder element 18L extends through the additional opening 24L in the retainer frame 22. Similar to the first bladder element 18A, the third bladder element 18L comprises a first portion 38 that rests against the first surface 26, a second portion 40 that rests against the second surface 30, and a necked portion 32L, indicated in plan view in FIG. 4, and shaped identically to necked portion 32A. Necked portion 32L extends through the additional opening 24L in the retainer frame 22, and connects the first portion 38 of the third bladder element 18L to the second portion 40 of the third bladder element 18L. The first portion 38 of the third bladder element 18L is in fluid communication with the second portion 40 of the third bladder element 18L through the necked portion 32L.

A method of manufacturing the article of footwear 10 may begin with forming the inner bladder elements 18A, 18B, 18C, 18D, 18E, 18F, 18G, 18H, 18I, 18J, 18K, and 18L, such as by any of blow-molding, thermoforming, or vacuum forming in mold assemblies. An inflation point, such as a fill tube, can be formed in each bladder element 18A, 18B, 18C, 18D, 18E, 18F, 18G, 18H, 18I, 18J, 18K, and 18L as is understood by those skilled in the art. Prior to inflation, the bladder elements 18A, 18B, 18C, 18D, 18E, 18F, 18G, 18H, 18I, 18J, 18K, and 18L can be inserted through the corresponding openings 24A, 24B, 24C, 24D, 24E, 24F, 24G, 24H, 24I, 24J, 24K, and 24L so that the retainer frame 22 is operatively connected to the bladder elements 18A, 18B, 18C, 18D, 18E, 18F, 18G, 18H, 18I, 18J, 18K, and 18L. The bladder elements 18A, 18B, 18C, 18D, 18E, 18F, 18G, 18H, 18I, 18J, 18K, and 18L can then be inflated with fluid to establish the fluid chambers 20A, 20B, 20C, 20D, 20E, 20F, 20G, 20H, 20I, 20J, 20K, and 20L at selected pressures.

Figure 17:
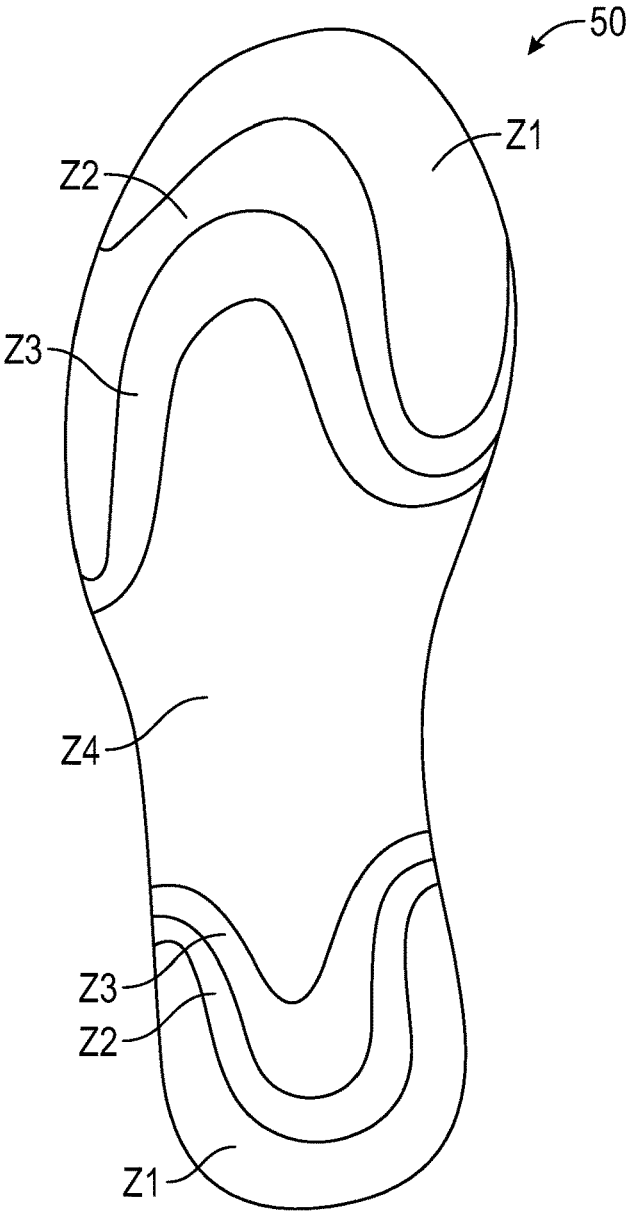
FIG. 17 is a schematic illustration of a predetermined map of pressures during wear testing of an article of footwear such as any of the articles of footwear of FIGS. 1-16.

Under the method, a pressure map of pressures applied during wear testing of a test article of footwear can be determined. For example, the pressures applied in a corresponding forefoot portion 13, midfoot portion 15, and heel portion 17 during wear of a test pair of the article of footwear 10 can be monitored and determined. A pressure map 50 is shown in FIG. 17. The pressure map 50 shows various zones Z1, Z2, Z3, and Z4. Each zone Z1, Z2, Z3, and Z4 corresponds to a range of magnitudes of pressures experienced in the various portions 13, 15, 17. Zone Z1 represents a first range of magnitudes of pressures. Zone Z2 represents a second range of magnitudes of pressures less than the first range. Zone Z3 represents a third range of magnitudes of pressures less than the second range. Zone Z4 represents a fourth range of magnitudes of pressures less than the third range. The fluid chambers 20A, 20B, 20C, 20D, 20E, 20F, 20G, 20H, 20I, 20J, 20K, and 20L can be inflated to respective pressures that correlate with the pressure map 50.

Next, the first and second polymeric sheets 19A, 19B used to form the first bladder element 14 can be inserted into mold halves of a mold assembly. The reinforcement frame 22 with inserted bladder elements 18A, 18B, 18C, 18D, 18E, 18F, 18G, 18H, 18I, 18J, 18K, and 18L can then be inserted into the mold assembly between the first and second polymeric sheets 19A, 19B. The first bladder element 14 can then be formed by thermoforming and vacuum forming, causing the first and second polymeric sheets 19A, 19B to conform to mold surfaces of the mold assembly. The perimeter seam 21 can be formed by compression of the mold assembly during thermoforming, or by radio frequency welding, to seal the first fluid chamber 16, with an inflation point such as a fill tube allowing fluid communication with the chamber 16. The elevated temperature of the sheets 19A, 19B during thermoforming causes them to bond to the bladder elements 18A, 18B, 18C, 18D, 18E, 18F, 18G, 18H, 18I, 18J, 18K, and 18L at certain locations of the outer surfaces of the bladder elements 18A, 18B, 18C, 18D, 18E, 18F, 18G, 18H, 18I, 18J, 18K, and 18L. The first fluid chamber 16 can then be inflated, or left at ambient pressure, and then any fill tubes are plugged.

Next, the cushioning assembly 12 can be secured to an upper 56, either directly, as shown in FIG. 1 or indirectly. The upper 56 can be secured to the cushioning assembly 12 by various methods, such as adhesives, stitching, a combination of these methods, or otherwise. The upper 56 can include a strobel unit that can overlay and be adhered to the upper surface cushioning assembly 12. Alternatively, the cushioning assembly 12 can be secured to the upper indirectly, such as via a midsole layer (not shown). The midsole layer may be an ethylene vinyl acetate (EVA) foam, or other type of cushioning material, that is in turn secured to the upper 56.

An outsole 58 may then be secured to the cushioning assembly 12. The outsole 58 can be a single, continuous, integral component that covers the entire ground-facing surface of the cushioning assembly 12. Alternatively, discrete outsole elements can be secured at different areas of the ground-facing surface of the cushioning assembly 12. The outsole 58 can be a high wear material, such as a durable rubber.

Figure 6:
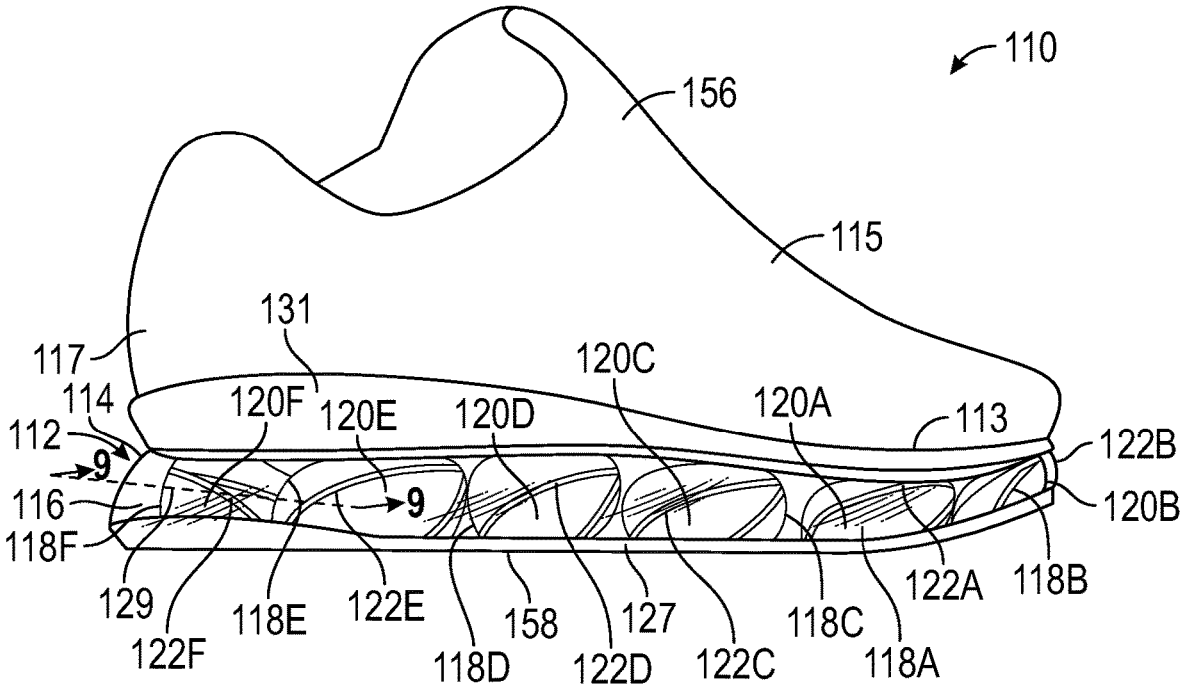
FIG. 6 is a schematic perspective illustration of an article of footwear including a cushioning assembly in accordance with an alternative aspect of the present teachings.

FIGS. 6-9 show another embodiment of an article of footwear 110 with a cushioning assembly 112. Like cushioning assembly 12, the cushioning assembly 112 also has multiple fluid-filled bladder elements, including a first bladder element 114 forming a first fluid chamber 116, and multiple additional bladder elements 118A, 118B, 118C, 118D, 118E, and 118F, also referred to as inner bladder elements, each forming a respective fluid chamber 120A, 120B, 120C, 120D, 120E, and 120F that is sealed from the fluid chamber 116. FIG. 6 shows only the inner bladder elements 118A, 118B, 118C, 118D, 118E, and 118F visible on the medial side 127 and from the rear 129 of the article of footwear 110. Still more additional bladder elements are arranged on the lateral side of the article of footwear 110, not visible in FIG. 6. Any or all of the bladder elements 114, 118A, 118B, 118C, 118D, 118E, and 118F can be formed from any of the same materials described with respect to the bladder elements 14, 18A of the cushioning assembly 12 of FIG. 1.

The bladder element 118A is referred to as a second bladder element. The fluid chamber 120A is referred to as a second fluid chamber and is sealed from the first fluid chamber 116 and within the first bladder element 114. Due to this arrangement, the first bladder element 114 is referred to as the outer bladder element, and the second bladder element 118A as well as bladder elements 118B, 118C, 118D, 118E, and 118F are referred to as inner bladder elements. The bladder element 114 is referred to as a full length bladder element as it extends from the forefoot portion 113 over the midfoot portion 115 to the heel portion 117. The cushioning assembly 112 includes a midsole layer 131 that may be an EVA foam or other material. The first bladder element 114 is secured to an underside of the midsole layer 131 such as by adhesive, thermal bonding, radio frequency welding or other methods. A footwear upper 156 is secured to the cushioning assembly 112 by adhesive, thermal bonding, radio frequency welding, stitching or other methods.

The second bladder element 118A is formed from a first polymeric sheet 119A and a second polymeric sheet 119B each having a peripheral flange 121A, 121B. The peripheral flanges 121A, 121B are secured to one another by adhesive, thermal bonding such as during thermoforming, compression bonding such as during thermoforming, radio frequency welding or other methods so that the joined peripheral flanges 121A, 121B form a peripheral seam that surrounds the second bladder element 118A and seals the second fluid chamber 120A.

A reinforcement element 122A, also referred to as a first collar 122A, is operatively connected to and in contact with the second bladder element 118A. The first collar 122A is configured to reinforce the cushioning assembly 112 under a load applied to the first bladder element 114. More specifically, the first collar 122A is secured to the peripheral flanges 121A, 121B and surrounds the second bladder element 118A at the flanges 121A, 121B to reinforce a peripheral seam 121C and limit deformation of the second bladder element 118A at the peripheral seam 121C. The first collar 122A limits deformation of the second bladder element 118A at the peripheral seam 121C so that the peripheral seam 121C will deform less than the remaining area of the second bladder element 118A. Shear forces along the peripheral seam 121C are reacted by the first collar 122A at a contact surface 121D of the first collar 122A in contact with the bladder element 118A. Each of the additional inner bladder elements 118B, 118C, 118D, 118E, 118F have a similar collar 122B, 122C, 122D, 122E and 122F at a respective peripheral flange and seam.

The peripheral seam 121C and the first collar 122A incline within the first bladder element 114 in a laterally outward direction of the article of footwear 110, as shown in FIG. 6 with respect to first collar 122A (with peripheral seam within and covered by the first collar 122A). A laterally outward direction is a direction perpendicular to a longitudinal centerline C, indicated in FIG. 9, of the article of footwear 110. For example, a laterally outward direction is toward a medial side 127 or toward a lateral side 123 indicated in FIG. 9. In this manner, the first collar 122A functions as a tether as it tends to limit or prevent laterally outward deformation of the second bladder element 118A at the peripheral seam 121C under compressive loads F2, F3, F4 applied to the cushioning assembly 112.

Figure 9:
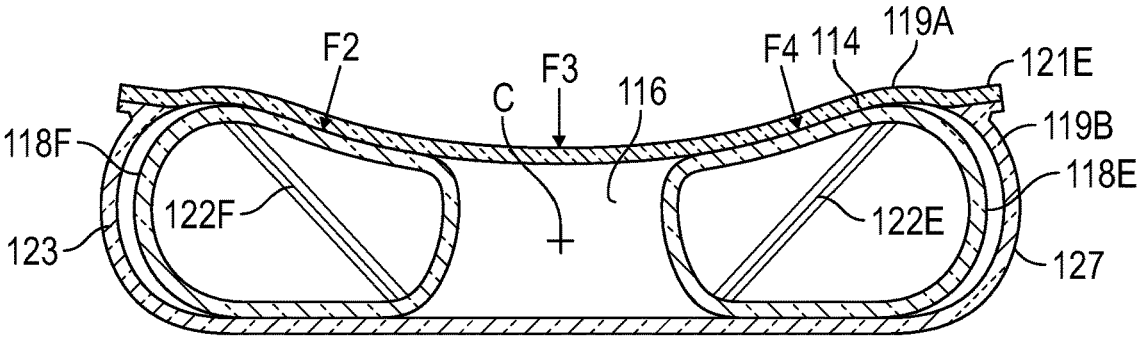
FIG. 9 is a schematic illustration in cross-sectional rear view of a portion of the cushioning assembly of the article of footwear of FIG. 6 taken at lines 9-9 in FIG. 6, with the outsole removed.

As indicated in FIG. 9, a collar 122E of the bladder element 118E and a collar 122F or the bladder element 118F also incline in laterally outward directions to limit deformation of the bladder elements 118E, 118F. The bladder element 118E is referred to as a third bladder element, and the collar 122E is referred to as a second collar. The bladder elements 118E and 118F are adjacent one another in the heel region of the cushioning assembly 112. Under loading occurring between the bladder elements as shown in FIG. 9, each tends to limit or prevent laterally outward deformation of the bladder elements 118E, 118F.

As described with respect to the cushioning assembly 12, the respective pressures of the fluid chambers 120A, 120B, 120C, 120D, 120E, 120F in an unloaded state can be selected to provide a desired cushioning profile during loading. The pressure of the first fluid chamber 116 can be at a different pressure in an unloaded state than the fluid chambers 120A, 120B, 120C, 120D, 120E, and 120F. For example, at least one of the fluid chambers 116, 120A, 120B, 120C, 120D, 120E, and 120F can be pressurized above an ambient pressure surrounding the first fluid chamber 116 when the cushioning assembly 112 is in an unloaded state. The fluid chamber 116 can be at ambient pressure or above ambient pressure. The fluid chambers 120A, 120B, 120C, 120D, 120E, and 120F can be inflated to respective pressures that correlate with the pressure map 50.

Figure 7:
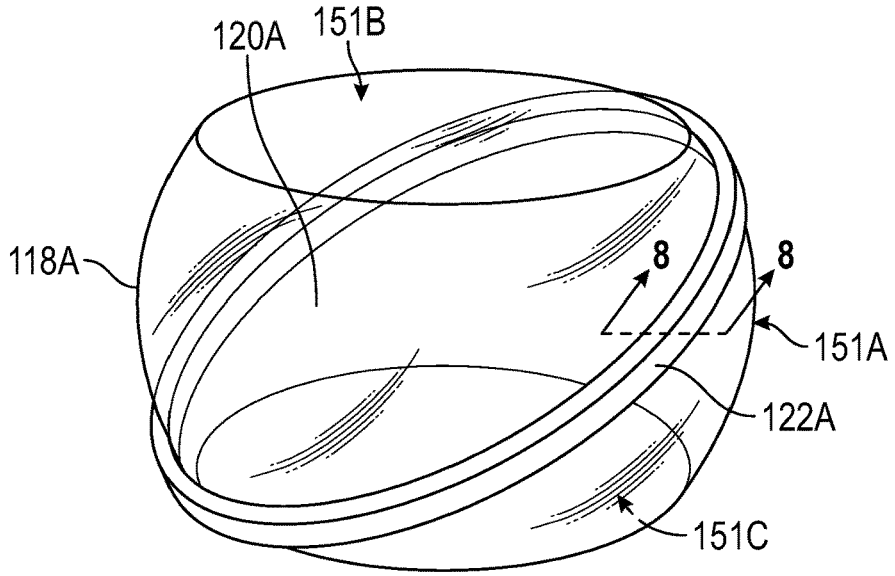
FIG. 7 is a schematic perspective illustration of an inner bladder element of the cushioning assembly of FIG. 6 with a collar secured to a flange and surrounding a peripheral seam of the inner bladder element.

A method of manufacturing the article of footwear 110 may begin with forming the inner bladder elements 118A, 118B, 118C, 118D, 118E, 18F, such as by any of blow-molding, thermoforming, or vacuum forming in mold assemblies. As shown in FIG. 7, the bladder elements 118A, 118B, 118C, 118D, 118E, and 118F can be molded with rounded side surface 151A and a flat top surface 151B and bottom surface 151C. An inflation point, such as a fill tube, can be formed in each bladder element 118A, 118B, 118C, 118D, 118E, 118F, 118G, 118H, 118I, 118J, 118K, and 118L as is understood by those skilled in the art. Prior to inflation, the bladder elements 118A, 118B, 118C, 118D, 118E, and 118F can be inserted in the center of the respective collars 122A, 122B, 122C, 122D, 122E, and 122F. The flanges 121A, 121B can then be inserted into the slotted opening 124 of the collar 122A. Pressure can be applied to the collar 122A to clamp the collar 122A against the flanges 121A, 121B as the collar 122A is secured to the flanges 121A, 121B by adhesive, thermal bonding, or other methods. The bladder elements 118A, 118B, 118C, 118D, 118E, and 118F can then be inflated with fluid to establish the fluid chambers 120A, 120B, 120C, 120D, 120E, and 120F at selected pressures.

Under the method, the pressure map 50 can be determined as described with respect to FIG. 17. The fluid chambers 120A, 120B, 120C, 120D, 120E, and 120F can be inflated to respective pressures that correlate with the pressure map 50.

Next, the first and second polymeric sheets 119A, 119B used to form the first bladder element 114 can be inserted into mold halves of a mold assembly. The inflated bladder elements 118A, 118B, 118C, 118D, 118E, and 118F with collars 122A. 122B, 122C, 122D, 122E, and 122F can then be inserted into the mold assembly between the first and second polymeric sheets 119A, 119B. The first bladder element 114 can then be formed by thermoforming and vacuum forming, causing the first and second polymeric sheets 119A, 119B to conform to mold surfaces of the mold assembly. A perimeter flange 121E of the first bladder element 114 can be formed by compression of the mold assembly during thermoforming, or by radio frequency welding, to seal the first fluid chamber 116, with an inflation point such as a fill tube allowing fluid communication with the chamber 116. The elevated temperature of the sheets 119A, 119B during thermoforming causes them to bond to the bladder elements 118A, 118B, 118C, 118D, 118E, and 118F at certain locations of the outer surfaces of the bladder elements 118A, 118B, 118C, 118D, 118E, and 118F, such as the top and bottom surfaces 151B, 151C of bladder element 118A indicated in FIG. 7. The first fluid chamber 116 can then be inflated, or left at ambient pressure, and then any fill tubes are plugged. Next, the cushioning assembly 112 can be secured to the upper 156, either directly or indirectly, as shown in FIG. 6, such as via the midsole layer 131. The upper 156 can be secured to the cushioning assembly 112 by various methods, such as adhesives, stitching, a combination of these methods, or otherwise. The upper 156 can include a strobel unit that can overlay and be adhered to the upper surface of the midsole layer 131 or the bladder element 114. An outsole 158 may then be secured to the cushioning assembly 112. The outsole 158 can be as described with respect to outsole 58 of FIG. 1.

FIGS. 10-15 show another embodiment of an article of footwear 210 with a cushioning assembly 212. The cushioning assembly 212 has multiple outer bladder elements 214A, 214B, and 214C. Outer bladder element 214A is referred to as the first bladder element. The first bladder element 214A forms a first fluid chamber 216A. Similarly, bladder element 214B forms fluid chamber 216B, and bladder element 214C forms fluid chamber 216C. Outer bladder elements 214A and 214C each have multiple additional bladder elements within the respective outer bladder elements 214A, 214C. Bladder elements 218A, 218B are within the first-fluid chamber 216A. Bladder element 218A is referred to as a second bladder element, and forms a fluid chamber 220A, referred to as a second fluid chamber. Bladder element 218B forms an additional fluid chamber 220B. The fluid chambers 220A, 220B are sealed from the fluid chamber 216A by the respective bladder elements 218A, 218B.

Figure 8:
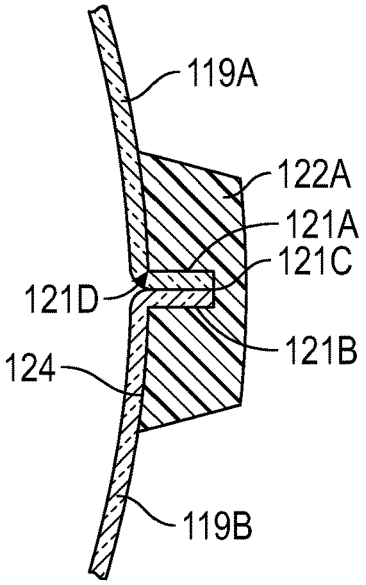
FIG. 8 is a schematic cross-sectional illustration of the collar and inner bladder element of FIG. 7 taken at lines 8-8 in FIG. 7.

Each bladder element 218A, 218B has a peripheral flange with a respective peripheral seam, similar to bladder element 118A of FIGS. 7 and 8, with an optional collar 222A, 222B secured to the flange similar to collar 122A of FIG. 7. Collars 222A, 222B are generally square as the bladder elements 218A, 218B have a generally square outer surface. The collars 222A, 222B incline in a laterally-outward direction similar to collar 122A.

Figure 10:
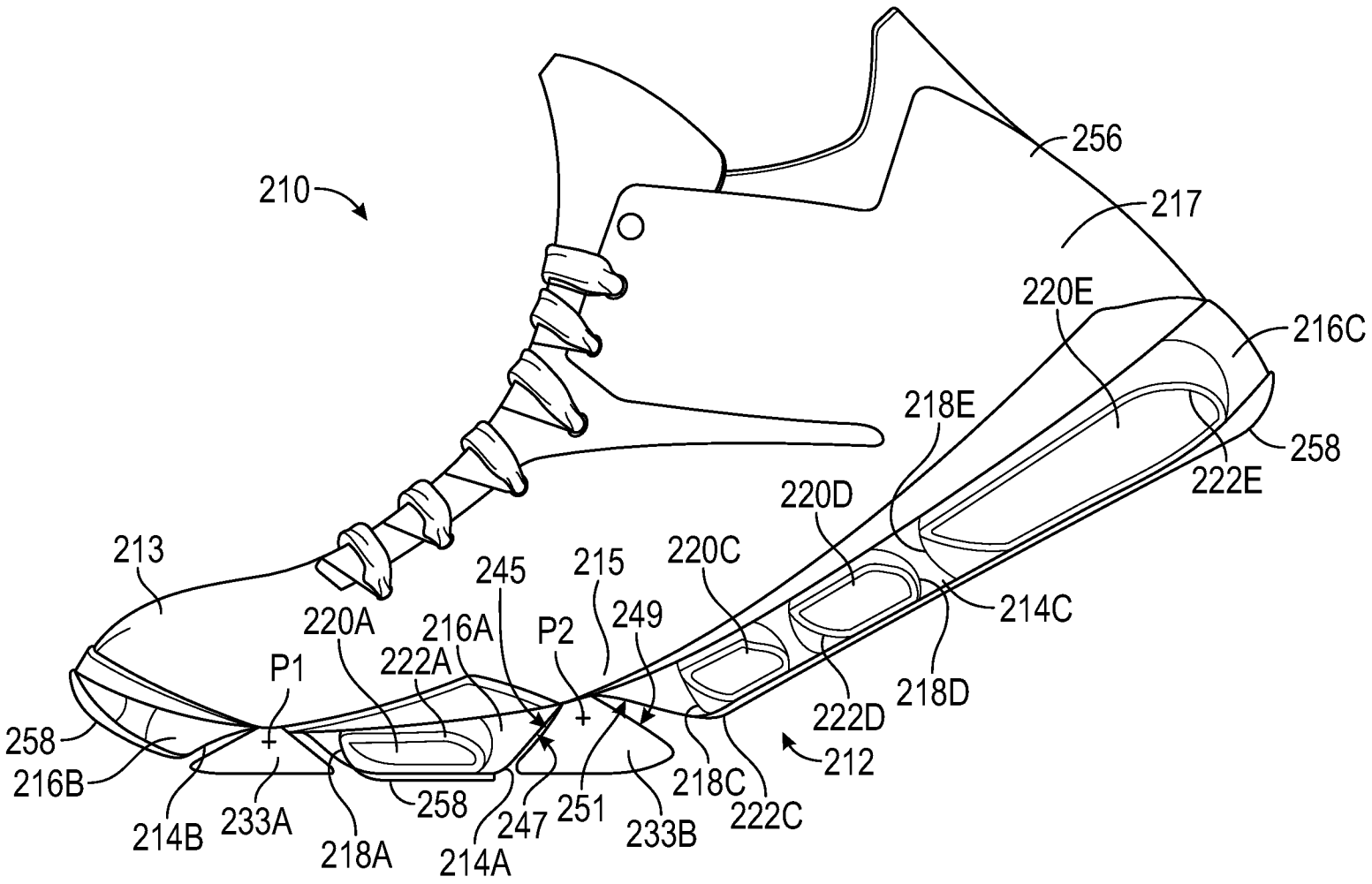
FIG. 10 is a schematic illustration in side view of a medial side of an article of footwear including a cushioning assembly in accordance with an alternative aspect of the present teachings, with the article of footwear flexed and a heel portion lifted.

Bladder element 214C also has a plurality of additional inner bladder elements 218C, 218D, 218E, only some of which are visible on the side view of FIG. 10. Each bladder element 218C, 218D, 218E forms a fluid chamber 220C, 220D, 220E sealed from and the fluid chamber 216C. Each bladder element 218C, 218D, 218E also has a peripheral flange forming a peripheral seam with an optional reinforcing collar 222C, 222D, 222E attached to the peripheral flange. Bladder element 214B has no inner bladder elements in the fluid chamber 216B. Instead, recesses 211 are formed at the outer surface of the bladder element 214B. All of the bladder elements 214A, 214B, 214C, 218A, 218B, 218C, 218D, 218E can be formed from the same materials as the bladder elements 14, 18A, as described with respect to FIG. 1.

FIG. 10 shows only the inner bladder elements 218A, 218C, 218D, and 218E visible on the medial side 227 of the article of footwear 210. Still more additional bladder elements may be arranged on the lateral side of the article of footwear 210, not visible in FIG. 10. Any or all of the bladder elements 214A, 214B, 214C, 218A, 218C, 218D, and 218E can be formed from any of the same materials described with respect to the bladder elements 14, 18A of the cushioning assembly 12 of FIG. 1.

The bladder element 218A is referred to as a second bladder element. The fluid chamber 220A is referred to as a second fluid chamber and is sealed from the first fluid chamber 216A and within the first bladder element 214A, 214B, and 214C. Due to this arrangement, the first bladder element 214A is referred to as the outer bladder element, and the second bladder element 218A as well as bladder elements 218C, 218D, and 218E are referred to as inner bladder elements. None of the bladder elements 214A, 214B, 214C are full length bladder elements as none extends from the forefoot portion 213 over the midfoot portion 215 to the heel portion 217.

Figure 11:
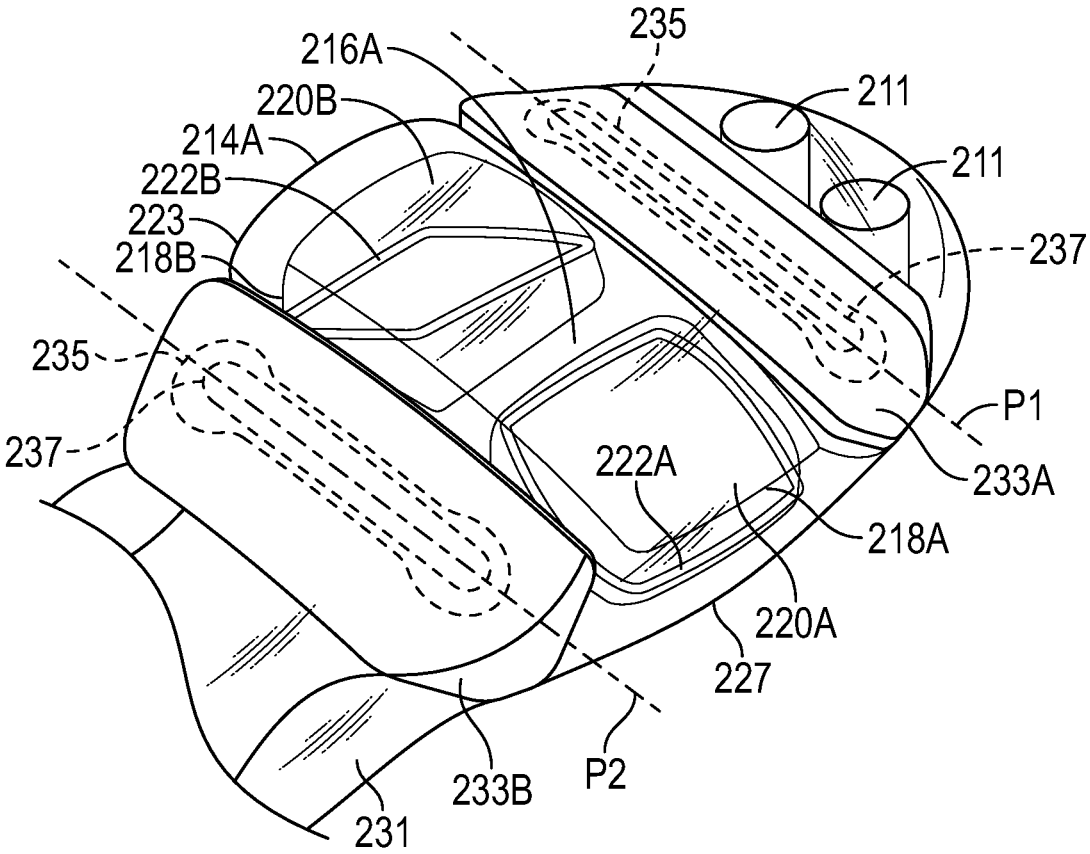
FIG. 11 is a schematic illustration in fragmentary perspective view of the cushioning assembly of FIG. 10.
Figure 12:
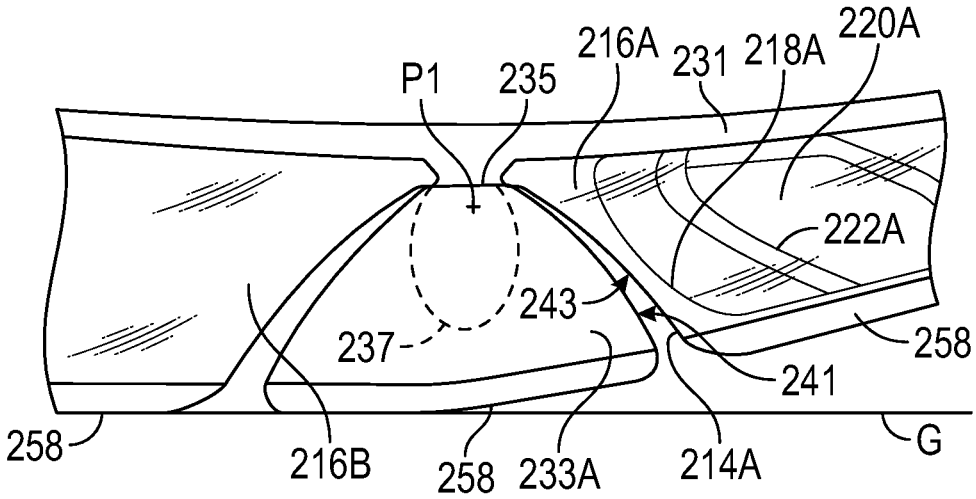
FIG. 12 is a schematic illustration in fragmentary side view of a portion of the cushioning assembly of FIGS. 10 and 11.

The cushioning assembly 212 includes a midsole layer 231, also referred to herein as a sole layer, shown best in FIG. 11. The midsole layer 231 may be an EVA foam or other material. The first bladder element 214A is secured to an underside of the midsole layer 231 such as by adhesive, thermal bonding, radio frequency welding or other methods. A footwear upper 256 is secured to the cushioning assembly 212 by adhesive, thermal bonding, radio frequency welding, stitching or other methods.

A first reinforcement element 233A is secured to the midsole layer 231. For example, the first reinforcement element 233A may be partially hollow, with an opening 235 at one end. The midsole layer 231 can be a foam material that is filled into the opening 235 to fill the hollow portion of the first reinforcement element 233A, thereby securing the first reinforcement element 233A to the midsole layer 231. The opening 235 is an elongated slot as shown in phantom in FIG. 11, and the backfilled portion 237 of the midsole layer 231 extends at least partially laterally across the cushioning assembly 212, as indicated in phantom in FIG. 11. The first reinforcement element 233A is secured to the midsole layer 231 and the first bladder element 214A is also secured to the midsole layer 231, the first reinforcement element 233A is operatively connected to first bladder element 214A.

Figure 13:
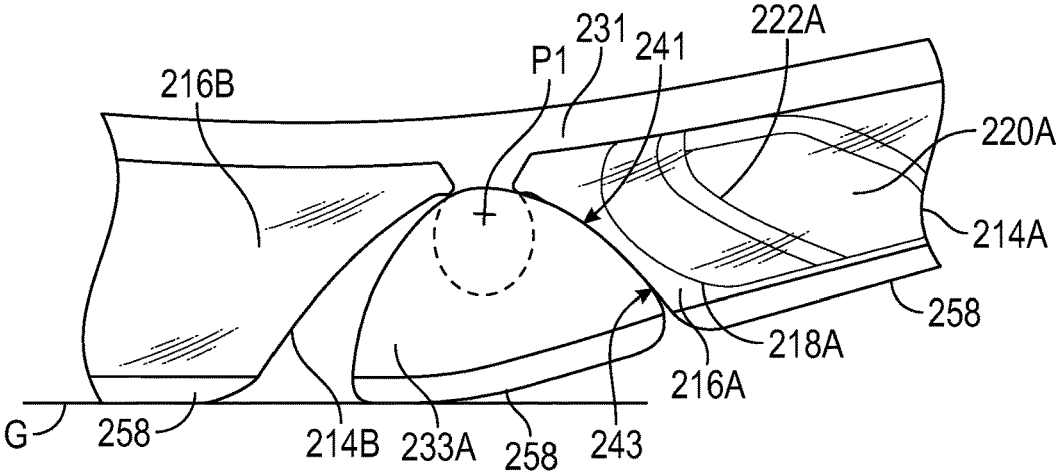
FIG. 13 is a schematic illustration in fragmentary side view of the cushioning assembly of FIG. 12.

The first reinforcement element 233A is secured to the midsole layer 231 to be pivotable at a first pivot axis P1 as a fulcrum. For example, in a neutral position, the entire outsole element 258 secured to the bottom of the reinforcement element 233A would be in contact with a ground plane G. The first reinforcement element 233A has a first reaction surface 241 that contacts a first portion of an outer surface 243 of the first bladder element 214A when the midsole layer 231 is pivoted about the first pivot axis P1, as shown in FIG. 13. The reinforcement element 233A is configured to limit deformation of the cushioning assembly 212 under a load applied to the first bladder element 214A. The reinforcement element 233A contacting the outer surface 243 acts as a barrier to prevent further deformation of the first bladder element 214A toward the reinforcement element 233A. The pivot axis P1 extends generally from a lateral side 223 of the article of footwear 210 to the medial side 227 of the article of footwear 210 so that the first reaction surface 241 is forward of the first bladder element 214A and the second bladder element 218A.

Figure 14:
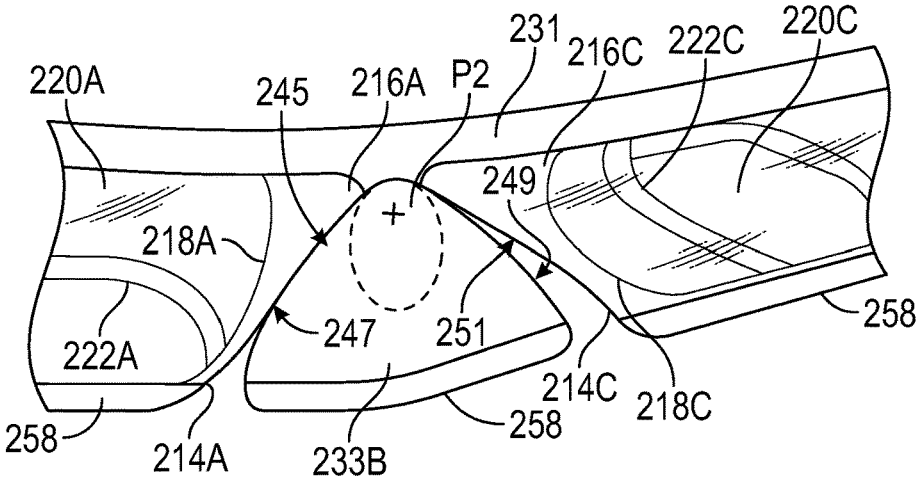
FIG. 14 is a schematic illustration in fragmentary side view of another portion of the cushioning assembly of FIGS. 10 and 11.

A second reinforcement element 233B is secured to the midsole layer 231 in the same manner as the first reinforcement element 233A. The second reinforcement element 233B is rearward of the first bladder element 214A and the second bladder element 218A. The second reinforcement element 233B is pivotable at a second pivot axis P2, and has a first reaction surface 245, indicated in FIG. 10, that contacts a second portion 247 of the outer surface of the first bladder element 214A when the second reinforcement element 233B is pivoted about the second pivot axis P2, as shown in FIG. 14.

As shown in FIG. 10, the third bladder element 214C is rearward of the second reinforcement element 233B. The bladder element 218C is referred to as the fourth bladder element, and is within the third bladder element 214C, and forms a fourth fluid chamber 220C sealed from and within the third fluid chamber 216C.

Figure 15:
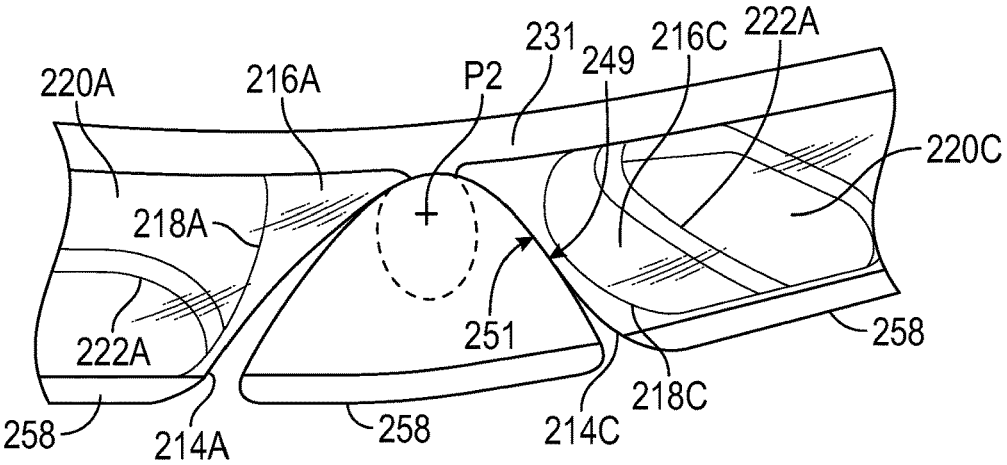
FIG. 15 is a schematic illustration in fragmentary side view of the cushioning assembly of FIG. 14.

The second reinforcement element 233B comprises a second reaction surface 249 that contacts a portion 251 of the outer surface of the third bladder element 214C when the second reinforcement element 233B is pivoted about the second axis P2, as shown in FIG. 15. The portion 251 of the outer surface of the third bladder element is rearward of the second reaction surface 249 and adjacent the fourth bladder element 218C. The second reinforcement element 233B thus reinforces the first bladder element 214A, as shown in FIG. 14, and reinforces the third bladder element 214C, as shown in FIG. 15.

A method of manufacturing the article of footwear 210 may begin with forming the inner bladder elements 218A, 218B, 218C, 218D, 218E, such as by any of blow-molding, thermoforming, or vacuum forming in mold assemblies. An inflation point, such as a fill tube, can be formed in each bladder element 218A, 218B, 218C, 218D, 218E as is understood by those skilled in the art. Prior to inflation, the bladder elements 218A, 218B, 218C, 218D, 218E can be inserted in the center of the respective optional collars 222A, 222B, 222C, 222D, 222E. The flanges of the bladder elements 218A, 218B, 218C, 218D, 218E can then be inserted into the slotted openings of the collars 222A, 222B, 222C, 222D, and 222E, and pressure can be applied to the collars 222A, 222B, 222C, 222D, and 222E to clamp the collars 222A, 222B, 222C, 222D, and 222E against the flanges as the collars 222A, 222B, 222C, 222D, and 222E are secured to the flanges by adhesive, thermal bonding, or other methods, and as explained with respect to similar flanges 121A, 121B of FIG. 8. The bladder elements 218A, 218B, 218C, 218D, 218E can then be inflated with fluid to establish the fluid chambers 220A, 220B, 220C, 220D, and 220E at selected pressures. Under the method, the pressure map 50 can be determined as described with respect to FIG. 17. The fluid chambers 220A, 220B, 220C, 220D, and 220E, can be inflated to respective pressures that correlate with the pressure map 50.

Next, first and second polymeric sheets used to form the first bladder element 214 can be inserted into mold halves of a mold assembly, as described with respect to bladder element 114. The inflated bladder elements 218A, 218B, with collars 222A, 222B can then be inserted into the mold assembly between the first and second polymeric sheets. The first bladder element 214A can then be formed such as by thermoforming and vacuum forming, causing the first and second polymeric sheets to conform to mold surfaces of the mold assembly. As described with respect to bladder element 114, a perimeter flange of the first bladder element 214A can be formed by compression of the mold assembly during thermoforming, or by radio frequency welding, to seal the first fluid chamber 216A, with an inflation point such as a fill tube allowing fluid communication with the chamber 216A. The elevated temperature of the sheets during thermoforming causes them to bond to the bladder elements 218A, 218B at certain locations of the outer surfaces of the bladder elements 218A, 218B where the sheets contact the bladder elements 218A, 218B, such as the top and bottom surfaces of bladder elements 218A, 218B. The first fluid chamber 216 can then be inflated, or left at ambient pressure, and then any fill tubes are plugged. The bladder elements 214B, 214C, 218C, 218D, 218E are similarly formed.

The reinforcement elements 233A, 233B are then secured to the midsole layer 231, such as by forming the midsole layer 231 in a mold assembly, and filling foam of the midsole layer 231 into the openings 235 in the reinforcement elements 233A, 233B, with are also positioned in the mold assembly. The bladder elements 214A, 214B, and 214C can be secured to the midsole 231 by a variety of methods, such as thermal bonding, adhesives of radio frequency welding.

Next, the cushioning assembly 212 can be secured to the upper 256, either directly or indirectly, such as via the midsole layer 231. The upper 256 can be secured to the cushioning assembly 212 by various methods, such as adhesives, stitching, a combination of these methods, or otherwise. The upper 256 can include a strobel unit that can overlay and be adhered to the upper surface of the midsole layer 231. An outsole 258 may then be secured to the cushioning assembly 112. The outsole 258 can be as described with respect to outsole 58 of FIG. 1.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. An article of footwear comprising:

a cushioning assembly comprising:

a first bladder element forming a first fluid chamber;

a second bladder element within the first bladder element and forming a second fluid chamber sealed from and within the first fluid chamber;

a frame configured as a single plate extending lengthwise within the first fluid chamber; wherein the frame has a peripheral edge and forms multiple openings inward of the peripheral edge and extending completely through the frame; wherein the second bladder element extends through a first opening of the multiple openings and is narrowed at and retained by the frame at the first opening; wherein the frame reinforces the cushioning assembly under a load applied to the first bladder element; and wherein the second bladder element extends transversely outward of the peripheral edge of the frame.

2. The article of footwear of claim 1, wherein the frame comprises a first side with a first surface and a second side with a second surface; wherein the second bladder element comprises a first portion that rests against the first surface, a second portion that rests against the second surface, and a necked portion that extends through the first opening in the frame and connects the first portion to the second portion; wherein the first portion is in fluid communication with the second portion through the necked portion so that a load applied to the second bladder element is reacted by both the first surface and the second surface of the frame.

3. The article of footwear of claim 2, wherein the first side of the frame is disposed upward and the second side of the frame is disposed downward when the article of footwear is in an upright position and the cushioning assembly is secured in the article of footwear so that the first portion is above the second portion and the second bladder element extends transversely outward of the peripheral edge both above the first side and below the second side.

4. The article of footwear of claim 2, wherein the cushioning assembly further comprises a third bladder element forming a third fluid chamber within the first fluid chamber and extending through an additional opening of the multiple openings; wherein the third bladder element comprises a first portion that rests against the first surface, a second portion that rests against the second surface, and a necked portion that extends through the additional opening in the frame and connects the first portion of the third bladder element to the second portion of the third bladder element; and wherein the first portion of the third bladder element is in fluid communication with the second portion of the third bladder element through the necked portion.

5. The article of footwear of claim 1, wherein at least one of the first fluid chamber and the second fluid chamber is pressurized above an ambient pressure surrounding the first fluid chamber when said at least one of the first fluid chamber and the second fluid chamber is in an unloaded state.

6. The article of footwear of claim 1, wherein:

the first bladder element and the second bladder element are each formed of polymeric sheets; and the frame is formed of at least one of thermoplastic polyurethane, thermoplastic elastomer, an EVA foam, a carbon fiber, or a composite of foam and carbon fiber.

7. The article of footwear of claim 6, wherein the first bladder element and the second bladder element are each formed of multi-layer sheets of alternating thermoplastic polyurethane layers and gas barrier layers.

8. The article of footwear of claim 1, wherein:

the article of footwear has a forefoot portion, a midfoot portion, and a heel portion;

the first bladder element and the first fluid chamber extend from the forefoot portion to the heel portion; and the frame extends from the forefoot portion to the heel portion.

9. The article of footwear of claim 1, wherein:

the cushioning assembly further comprises a third bladder element forming a third fluid chamber within the first fluid chamber and extending through an additional opening of the multiple openings; and the third bladder element extends transversely outward of the peripheral edge of the frame.

10. An article of footwear comprising:

a cushioning assembly comprising:

a first bladder element forming a first fluid chamber;

a plurality of additional bladder elements within the first bladder element each forming an additional fluid chamber sealed from and within the first fluid chamber;

a frame configured as a single plate extending lengthwise within the first fluid chamber; wherein the frame forms multiple openings extending completely through the frame;

wherein at least some of the multiple openings have different shapes from one another and the plurality of additional bladder elements have different shapes corresponding with the different shapes of the multiple openings; wherein each of the plurality of additional bladder elements extends through a different one of the multiple openings and is narrowed at and retained by the frame at the different one of the multiple openings; wherein the frame reinforces the cushioning assembly under a load applied to the first bladder element and wherein each of the plurality of additional bladder elements extends transversely outward of a peripheral edge of the frame.

11. The article of footwear of claim 10, wherein the frame extends from a forefoot portion of the article of footwear to a heel portion of the article of footwear.

12. The article of footwear of claim 11, wherein the first bladder element is exposed at an exterior of the article of footwear from the forefoot portion to the heel portion.

13. The article of footwear of claim 10, wherein:

the first bladder element includes a first multi-layer sheet and a second multi-layer sheet enclosing the first fluid chamber; and the first multi-layer sheet and the second multi-layer sheet are bonded to one another only at a peripheral flange of the first bladder element.

* * * * *